US005503134A

United States Patent [19]

Delosh et al.

[11] Patent Number: 5,503,134

[45] Date of Patent: Apr. 2, 1996

[54] FUEL CONTROLLER WITH AIR/FUEL TRANSIENT COMPENSATION

[75] Inventors: Robert G. Delosh, Ann Arbor; Douglas R. Hamburg, Bloomfield, both of Mich.

[73] Assignee: Ford Motor Company, Dearborn, Mich.

[21] Appl. No.: 130,810

[22] Filed: Oct. 4, 1993

[51] Int. Cl.[6] ..... F02D 41/14

[52] U.S. Cl. ..... 123/687; 123/696

[58] Field of Search ..... 123/687, 694, 123/696, 695

[56] References Cited

U.S. PATENT DOCUMENTS

| | | | |
|---|---|---|---|
| 3,782,347 | 1/1974 | Schmidt et al. | 123/687 |
| 4,290,400 | 9/1981 | Pomerantz | 123/696 |
| 4,357,923 | 11/1982 | Hideg | 123/492 |
| 4,635,200 | 1/1987 | Egami et al. | 364/431.05 |

FOREIGN PATENT DOCUMENTS

| | | |
|---|---|---|
| 0282841 | 9/1988 | European Pat. Off. . |
| 2071361 | 9/1981 | United Kingdom . |
| 2144885 | 3/1985 | United Kingdom . |
| 2257546 | 1/1993 | United Kingdom . |

OTHER PUBLICATIONS

SAE Technical Paper Series *A Closed–Loop A/F Control Model for Internal Combustion Engines,* Hamburg, et al. Jun., 1980.

SAE Technical Paper Series *Fuel Injection ControlSystems that Improve Three Way Catalyst Conversion Efficiency,* Katashiba, et al. Feb., 1991.

*Primary Examiner*—Andrew M. Dolinar

*Attorney, Agent, or Firm*—Alan J. Lippa; Roger L. May

[57] ABSTRACT

A fuel control system operates under closed-loop control to sense the oxygen content of the combustion products of an internal combustion engine along with the engine angular velocity and air flow through the intake manifold and to alter the composition of air and fuel combusted by the engine, such that under stable closed-loop control, the air/fuel composition generally oscillates about stoichiometry between a minimum and a maximum value. The rate of fluctuation of the oxygen content of the combustion products is monitored and if the oxygen content does not switch when expected, then a transient change in the exhaust content of the exhaust gas is assumed and a transient response is generated. The transient response comprises the generation of an air/fuel ratio substantially equal in magnitude and time but opposite in direction from the detected transient. After the transient response, periodic fluctuation of the air/fuel ratio between the minimum and maximum values is resumed.

10 Claims, 4 Drawing Sheets

FUEL CONTROLLER WITH AIR/FUEL TRANSIENT COMPENSATION

FIELD OF THE INVENTION

This invention relates to methods and apparatus for adaptively controlling the delivery of fuel to an internal combustion engine and more particularly, although in its broader aspects not exclusively, to an arrangement for detecting transient conditions and for adaptively altering the amount of fuel delivered to the engine to compensate for the transient condition.

BACKGROUND OF THE INVENTION

Modern automotive engines typically utilize a catalytic converter to reduce the exhaust gas emissions produced by the engine. Such converters operate to chemically alter the exhaust gas composition produced by the engine to help meet various environmental regulations governing tailpipe emissions. Catalytic converters typically operate at peak efficiency when the ratio of air and fuel (A/F) entering the converter is within a narrow range centering about stoichiometry.

Electronic fuel control systems are increasingly being used in internal combustion engines to precisely meter the amount of fuel required for varying engine requirements. Such systems control the amount of fuel delivered for combustion in response to multiple system inputs including throttle angle and the exhaust gas composition produced by combustion of air and fuel. Electronic fuel control systems operate primarily to maintain the A/F at or near stoichiometry. Electronic fuel control systems operate in a variety of modes depending on engine conditions such as starting, rapid acceleration, sudden deceleration, and idle. A primary mode of operation is closed-loop A/F control.

Closed-loop A/F control is utilized when certain engine operating conditions are satisfied. Under closed-loop A/F control, the amount of fuel delivered is primarily determined by an estimate of mass air charge. The amount of fuel is then modified by a value related to the concentration of oxygen in the exhaust gas, such concentration being indicative of the fuel-air composition that has been ignited. The resulting quantity of fuel injected into the engine corresponds precisely to the engine operating conditions and results in lower tailpipe emissions.

In closed-loop A/F operation, the oxygen in the exhaust gas is sensed by an oxygen sensor. The electronic fuel control system adjusts the amount of fuel being delivered in response to the output of the oxygen sensor. A sensor output indicating a rich air/fuel mixture (an A/F below stoichiometry) will result in a decrease in the amount of fuel being delivered. A sensor output indicating a lean air/fuel mixture (an A/F above stoichiometry) will result in an increase in the amount of fuel being delivered.

In conventional closed-loop electronic fuel control systems employing switching-type oxygen sensors, the A/F will oscillate above and below stoichiometry at a limit-cycle frequency determined by the characteristics of the system. Such operation will generally keep the catalytic converter operating at its peak efficiency, thereby reducing tailpipe emissions. However, if an A/F transient error is imposed on known fuel control systems, the exhaust A/F will shift away from stoichiometry for a certain time period until the feedback signal can correct the error. During the time that the A/F is shifted away from stoichiometry, the efficiency of the catalytic converter will be reduced and its ability to chemically alter the exhaust gas produced by the engine will be diminished. As a result, tailpipe emissions will increase until the catalytic converter subsequently regains its full capacity with oscillation of lean and rich exhaust gas composition around stoichiometry.

SUMMARY OF THE INVENTION

It is a primary object of the present invention to minimize tailpipe emissions of an internal combustion engine by compensating for transient air/fuel variations in order to restore the oxygen storage capacity of a catalytic converter to its pre-transient state. In accordance with the primary object of the invention, the oxygen content of the exhaust gases produced by an internal combustion engine is monitored and fed back to the engine fuel conroller, thereby producing a periodic oscillation of the oxygen content of the exhaust gas about stoichiometry. The period of the oscillation is monitored, and if a transient excursion in the oxygen content is detected, then the A/F is altered in a manner to generate an exhaust gas correction having an A/F substantially equal in magnitude and duration to the detected transient excursion but of opposite direction. Afterward, the periodic oscillation in the A/F is resumed.

An advantage, especially of certain preferred embodiments of the invention, is to reduce tailpipe emissions, and in particular, to reduce tailpipe emissions caused by A/F transients. By responding to A/F transients, preferred embodiments of the present invention are capable of quickly restoring the capacity of a catalytic converter to chemically alter the exhaust gas produced by the engine, thereby reducing tailpipe emissions following an A/F transient. These and other features and advantages of the present invention may be better understood by considering the following detailed description of a preferred embodiment of the invention. In the course of this description, reference will frequently be made to the attached drawings.

BRIEF DESCRIPTION OF THE DRAWINGS

FIG. 4(*b*) is a graph showing the variation in A/F over time for an engine utilizing the preferred embodiment of the present invention.

DETAILED DESCRIPTION

Figure 1:
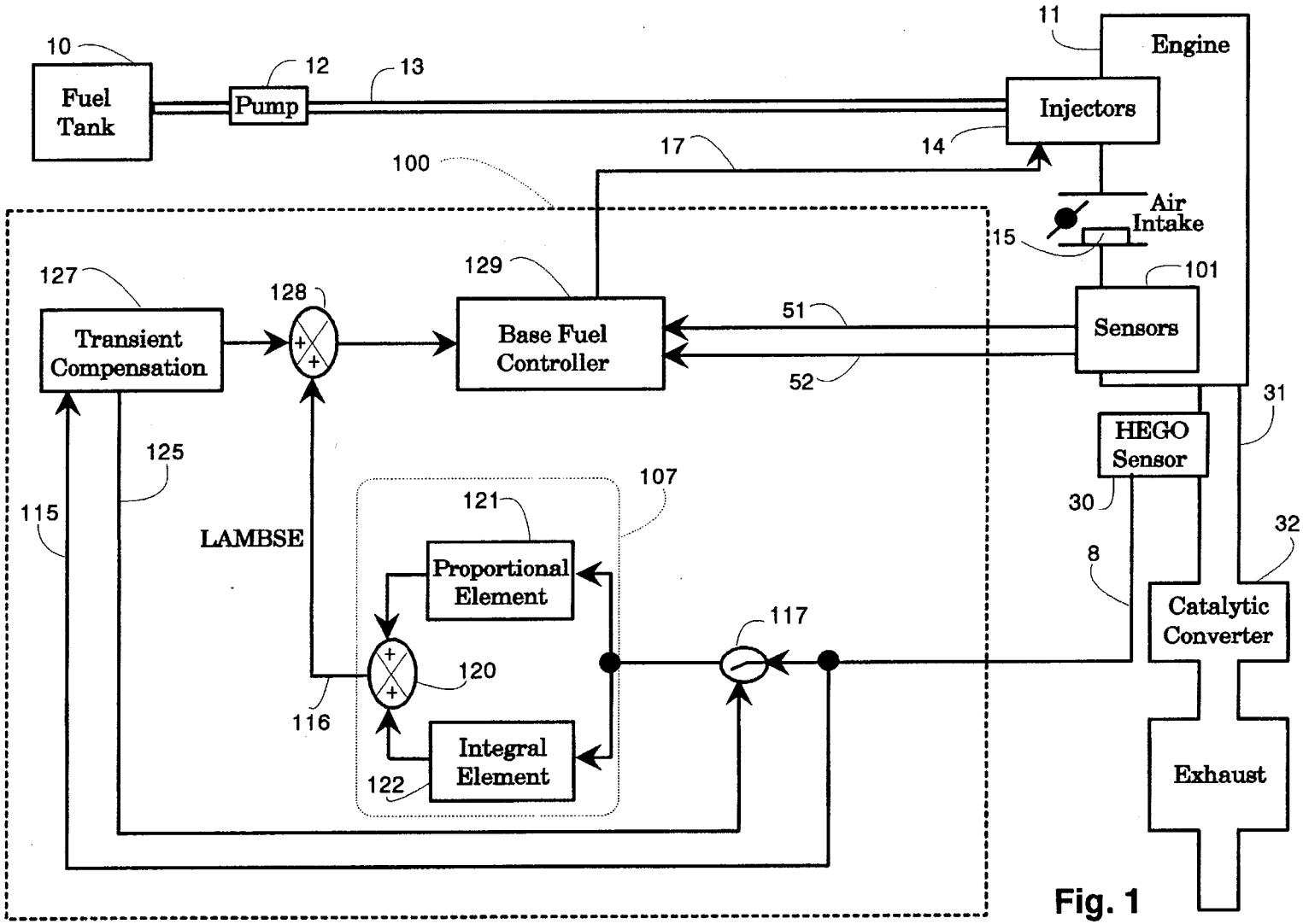
FIG. 1 is a schematic diagram of an internal combustion engine and an electronic fuel control system which embodies the invention.

FIG. 1 of the drawings shows a system which embodies the principles of the invention. A fuel pump 12 pumps fuel from a fuel tank 10 through a fuel line 13 to a set of fuel injectors 14 which inject fuel into an internal combustion engine 11. The fuel injectors 14 are of conventional design and are positioned deliver fuel to their associated cylinders in precise quantities. The fuel tank 10 advantageously contains liquid fuels such as gasoline, methanol, or a combination of fuel types.

A heated exhaust gas oxygen (HEGO) sensor 30, positioned in the exhaust system 31 of the engine 11, detects the oxygen content of the exhaust gas generated by the engine 11, and transmits a representative signal 8 to an Electronic Engine Controller (EEC) 100. The preferred embodiment utilizes a HEGO type oxygen sensor. However, other types of oxygen sensors such as an unheated exhaust gas oxygen (EGO) sensor or a universal exhaust gas oxygen (UEGO) sensor may be used. Still other sensors, indicated generally at 101, provide additional information about engine operation to the EEC 100, such as crankshaft position, throttle position and specifically, engine angular velocity via signal line 51 and mass flow rate of air (load) via signal line 52. The information from these sensors is used by the EEC 100 to control engine operation.

A mass air flow detector 15 positioned at the air intake of engine 11 detects the amount of air being supplied to the cylinders for combustion. The EEC 100 implements the functions shown in block diagram form within the dashed line 100 in FIG. 1. The EEC functions 100 are preferably implemented by one or more microcontrollers, each being comprised of one or more integrated circuits providing a processor, a read-only memory (ROM) which stores configuration data and the programs executed by the processor, peripheral data handling circuits, and a random access read/write scratchpad memory for storing dynamically changing data. These microcontrollers typically include built-in analog-to-digital conversion capabilities useful for translating analog signals from sensors and the like into digitally expressed values, as well as timer/counters for generating timed interrupts.

A microcontroller within the EEC 100 further implements a proportional plus integral (P-I) controller seen at 107 which is comprised of a proportional element 121, an integral element 122 and an adder element 120 for summing together the output of the proportional element 121 and the integral element 122. The HEGO signal 8 has the value +1 when the HEGO sensor indicates an A/F rich of stoichiometry, and a value of −1 when the A/F indicated by the HEGO sensor is lean of stoichiometry (rich of stoichiometry is understood to mean an A/F less than stoichiometry, and lean of stoichiometry is understood to mean an A/F greater than stoichiometry). The P-I controller 107 responds to the binary HEGO signal 8 to control the amount of fuel delivered by the injectors 14 by supplying an air-fuel feedback signal 116 called LAMBSE, which represents a desired change in relative A/F, to a further control module 129 which calculates a fuel delivery value in response to the modified air-fuel feedback signal LAMBSE and the engine angular velocity and load, and supplies the resulting fuel delivery value signal 17 to the injectors 14.

The base fuel controller 129 also receives data concerning engine angular velocity (rpm) and normalized mass air flow rate (load) via sensor signals 51 and 52 from the engine sensors 101. These signals in combination indicate an estimated air charge value for each cylinder of the engine (cylinder air charge). The preferred embodiment utilizes engine angular velocity and mass air flow rate to determine an estimate of the cylinder air charge value for the engine. Alternatively, other indicators, such as a combination of manifold pressure and engine angular velocity may also be used to determine an estimate of the cylinder air charge value for the engine.

The P-I controller 107 determines, according to the HEGO signal 8, whether the fuel delivery rate at the injectors 14 is to be increased or decreased, depending upon whether the HEGO sensor 30 indicates an oxygen level above or below stoichiometry, respectively. Such a controller may take the form described by D. R. Hamburg and M. A. Schulman in SAE Paper 800826.

The transient compensation module, seen at 127, advantageously compensates for transient fluctuations in the A/F resulting from rapid throttle movements by altering the air/fuel feedback signal LAMBSE at 128 in response to changes in the HEGO signal 8. As will be explained, such compensation restores the oxygen storage capacity of the catalytic converter 32 to the state which existed prior to the A/F transient.

Figure 2A:
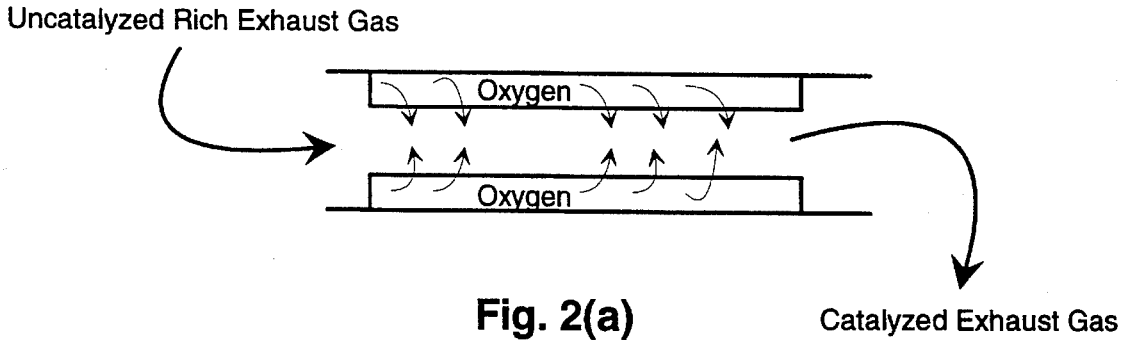
FIGS. 2(*a–b*) are diagrams showing conceptually the operation of a catalytic converter.
Figure 2B:
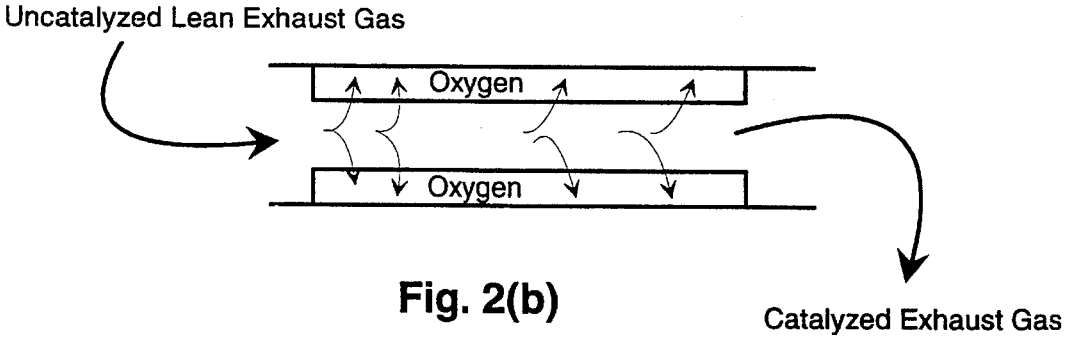

FIGS. 2(*a*) and 2(*b*) show conceptually the manner in which a catalytic converter operates to reduce emissions exhausted by an internal combustion engine. FIG. 2(*a*) depicts the situation where an air/fuel composition which is rich of stoichiometry has been ignited in the engine, and FIG. 2(*b*) depicts the opposite situation where an air/fuel composition which is lean of stoichiometry has been ignited. The catalytic converter contains an oxygen storage facility which is capable of supplying oxygen to a rich air/fuel composition, as shown in FIG. 2(*a*) and absorbing oxygen from a lean air/fuel composition, as shown in FIG. 2(*b*). By absorbing oxygen from a lean air/fuel composition and supplying oxygen to a rich air/fuel composition, the catalytic converter generates a catalyzed exhaust gas which is substantially lower in unwanted emissions than either the uncatalyzed lean exhaust gas or the uncatalyzed rich exhaust gas.

In normal operation, the catalytic converter is exposed to a cyclic variation of lean and rich exhaust gases which alternately deplete and restore the oxygen storage capacity of the catalytic converter. However, when an A/F transient occurs, the amount of oxygen required to be absorbed or supplied may either exceed or deplete the oxygen storage capacity of the catalyst. If this occurs, catalyst breakthrough will result with an attendant increase in tailpipe emissions.

Figure 4A:
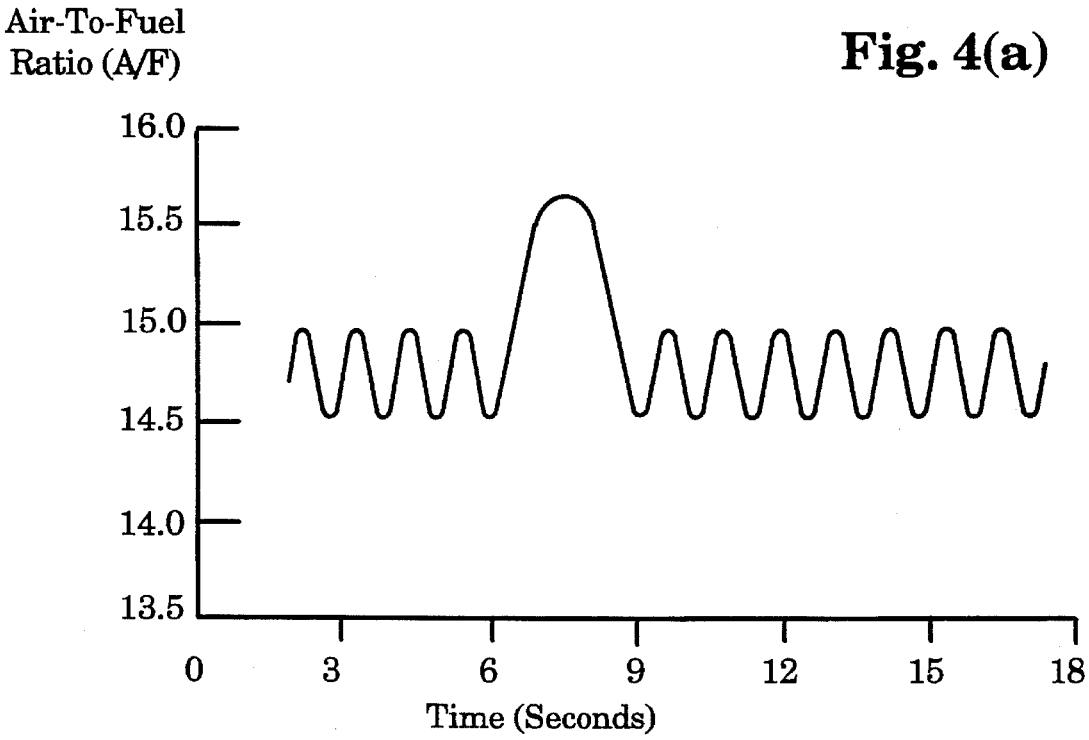
FIG. 4(*a*) is a graph showing the variation in A/F over time for an engine utilizing a known method of fuel control.
Figure 4B:
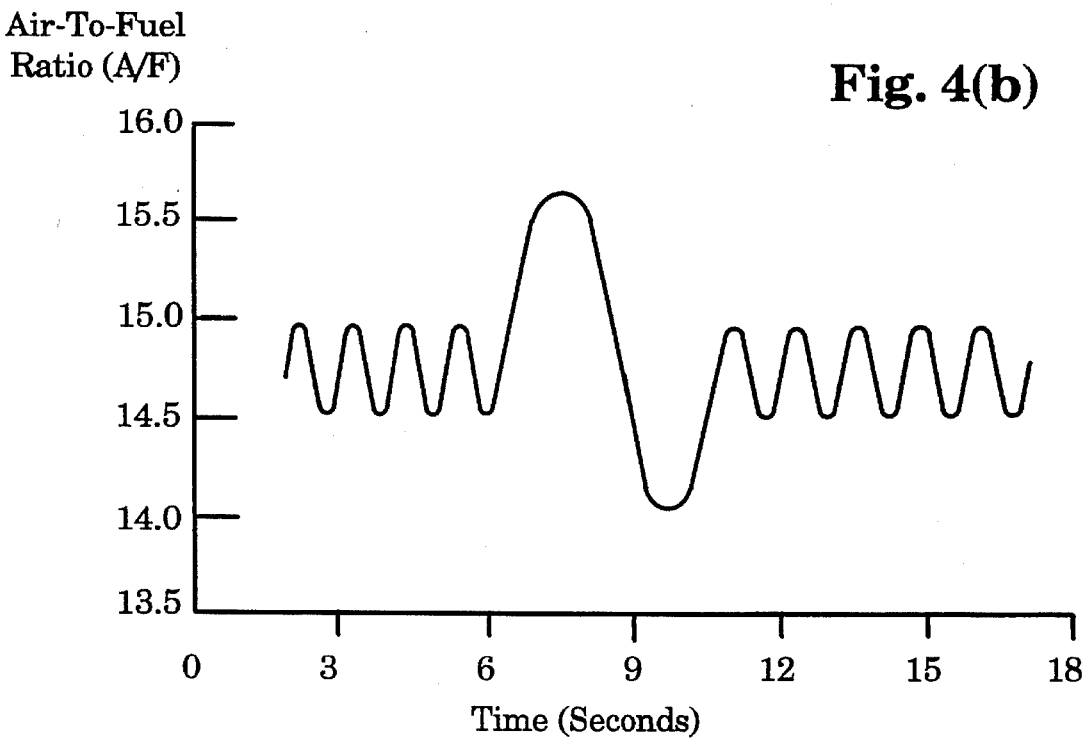

FIG. 4(*a*) shows an example of the variation in A/F against time, along with a transient air/fuel condition, in a known method of fuel control. As can be seen, the A/F oscillates periodically about stoichiometry between a maximum and minimum value from approximately three to six seconds. Between six and nine seconds, a transient occurs which has an A/F amplitude substantially larger than the maximum value exhibited by the periodic oscillation. At nine seconds, the known method of fuel control continues the periodic oscillation.

A catalytic converter receiving the exhaust products of combustion of the A/F waveform shown in FIG. 4(*a*) will alternately sink or source oxygen for the combustion products of the A/F function shown between three and six seconds. For the combustion products of the A/F function between six and nine seconds, the catalyst will absorb (sink) the excess amount of oxygen. However, such a large absorption can result in oxygen storage depletion, here characterized by an inability of the catalyst to absorb oxygen for any subsequent lean A/F excursions which might occur from nine seconds onward. Consequently, increased tailpipe emissions can result for any small lean A/F excursions occurring from nine seconds onward, until the excess amount of oxygen in the catalyst has been restored by the feedback system with its periodic rich/lean oscillations around stoichiometry.

FIG. 4(*b*) shows an example of the operation of the preferred embodiment of the present invention for a similar situation. From three to six seconds, the A/F oscillates periodically about stoichiometry between a maximum and minimum value. At six seconds, a transient occurs which has an A/F amplitude substantially larger than the maximum value exhibited by the periodic oscillation. At nine seconds, the preferred embodiment, rather than resuming the normal periodic air/fuel oscillation, responds to the transient by decreasing the A/F by a magnitude substantially similar and opposite in direction from stoichiometry than the transient. After responding to the transient, the preferred embodiment continues the periodic oscillation of the A/F between the maximum and minimum values. The periodic oscillation is initiated with an oscillation in a direction opposite that of the response to the transient. Consequently, since the response to the transient shown in FIG. 4(*b*) was in a rich direction, the first periodic oscillation is in a lean direction.

A catalytic converter receiving the exhaust products of combustion of the A/F waveform shown in FIG. 4(*b*) will alternately sink or source oxygen for the combustion products of the A/F function shown between three and six seconds. For the combustion products of the A/F function between six and nine seconds, the catalyst will absorb (sink) the excess amount of oxygen. Between nine and approximately twelve seconds, the catalytic converter will supply (source) an amount of oxygen substantially equal to the amount absorbed between six and nine seconds. Accordingly, the catalytic converter receiving the exhaust products of the combustion of the A/F function produced by the preferred embodiment of the present invention will not suffer from the oxygen storage depletion described above. Consequently, tailpipe emissions will not increase for small lean A/F excursions occurring immediately after twelve seconds.

Figure 3:
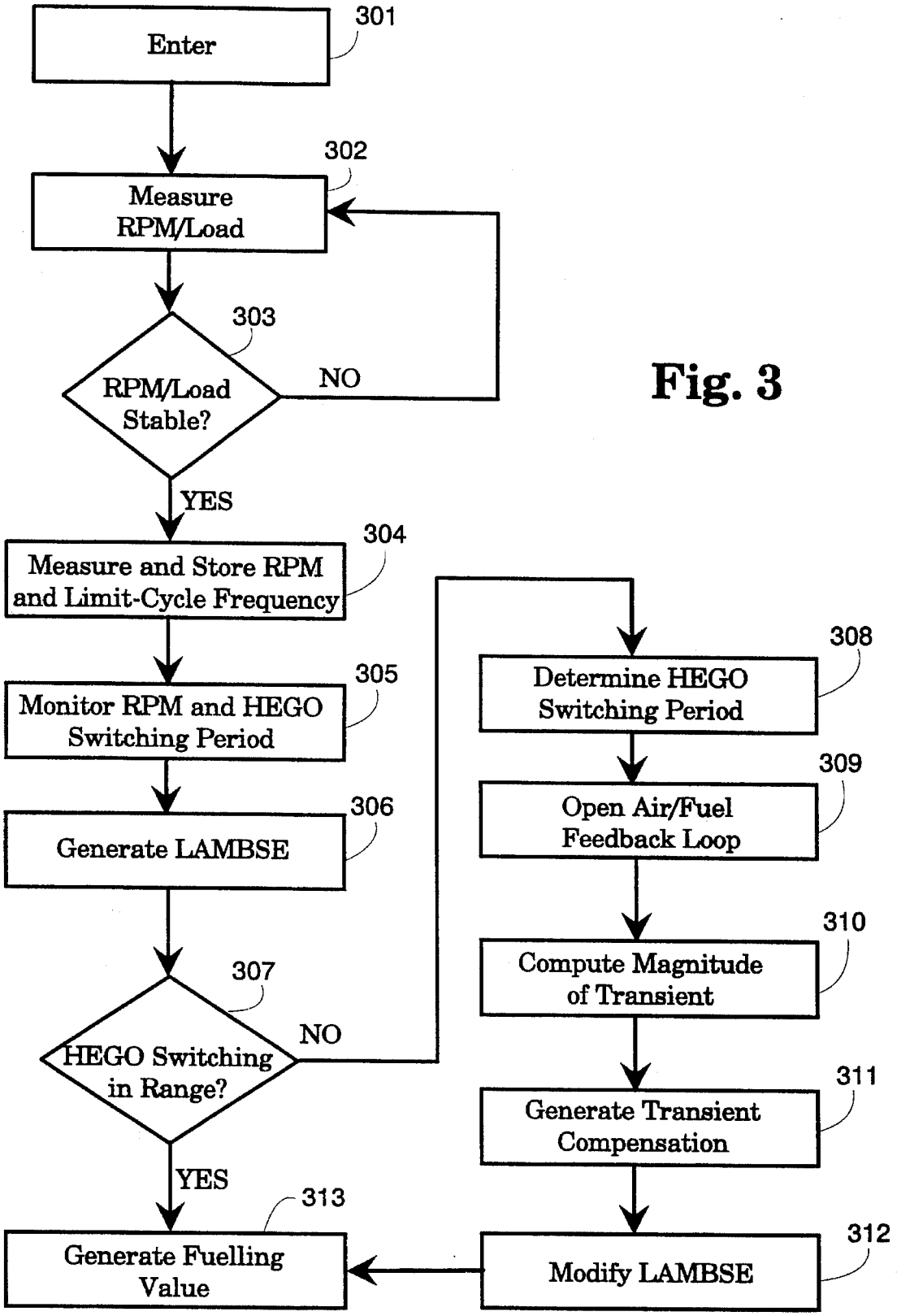
FIG. 3 is a flowchart showing the operation of a preferred embodiment of the invention.

FIG. 3 of the drawings shows the general sequence of steps during the operation of the preferred embodiment of the present invention. The steps shown in FIG. 3 are performed when the EEC 100 is operating the engine under a closed-loop method of operation and are preferably performed by the microcontroller within the EEC 100. The steps are initiated at 301, and at 302 the engine angular velocity in revolutions per minute (engine RPM) is measured along with the mass flow rate of air into the engine intake manifold (load). The loop comprising steps 302 and 303 is performed until the rpm and load are determined to be stable. Afterward, at 304 the RPM value is stored and the frequency of oscillation of LAMBSE, the limit-cycle frequency, is measured and stored in the memory contained in the EEC 100. At 305, the RPM is again measured and the switching period of the HEGO sensor 30 is measured. A value for the air/fuel feedback signal LAMBSE is generated at 306, and at 307, the switching period (or inversely, the switching frequency) of the HEGO sensor is checked to determine if the sensor is switching at an expected time. Such a determination is advantageously calculated from the stored limit-cycle frequency which is related to the switching period of the HEGO sensor and consequently can be used to predict when the sensor will switch. If the HEGO sensor is detected to be switching at an expected time, then a periodic fueling value is generated at 313 as a function of the RPM, load and LAMBSE. If the HEGO sensor fails to switch at the expected time, the occurrence of a transient is assumed.

In response to the detected transient, the additional time required for the HEGO sensor to switch is determined at 308. The air/fuel feedback loop utilized during closed-loop operation is then opened at 309. This operation, which can be seen conceptually in FIG. 1 at 117 where the transient compensation block 127 operates the switch 117 via path 125, is necessary in order to prevent the air/fuel feedback loop from cancelling the transient compensation applied to LAMBSE at 128. The air/fuel feedback loop remains open during the period of the transient compensation. Accordingly, LAMBSE advantageously remains at the value it had when the transient ended. At 310, the magnitude of the transient is calculated from the additional time required for the sensor to switch and the rate of change of LAMBSE. A transient compensation value is generated at 311 and is used at 312 to modify LAMBSE, as shown in FIG. 1 at 128. The transient compensation value will be either a positive or a negative value depending on whether the transient was in the rich or lean direction.

The fuelling value generated at 313 will preferably result in an A/F which is substantially equal in duration and magnitude, albeit in an opposite direction, to the detected transient. Such a method advantageously restores the oxygen storage capacity of the catalytic converter while minimizing variation in engine torque. The storage capacity can alternatively be restored more quickly by shortening the duration of the transient response while increasing the magnitude. Such a method, however, will result in a greater variation in engine torque.

The preferred embodiment described utilizes a HEGO sensor which switches between a rich and a lean value. The principles of the present invention, however, may also be utilized in a system which utilizes a linear oxygen sensor. For such a sensor, the actual amplitude and duration of the transient can be determined directly from the output of the sensor. Consequently, according to the principles of the present invention, in a system utilizing a linear oxygen sensor, a transient would be detected by first filtering out high frequency noise fluctuations, and then determining for how long a time period the sensor was above or below its normal steady state value. The magnitude of the transient would be determined by measuring the peak amplitude of the sensor output during the transient. An appropriate response, as described above, could then be calculated.

It is to be understood that the specific mechanisms and techniques which have been described are merely illustrative of one application of the principles of the invention. Numerous modifications may be made to the methods and apparatus described without departing from the true spirit and scope of the invention.

What is claimed is:

1. An air/fuel control system for an internal combustion engine comprising:

sensor means for detecting the level of oxygen in the exhaust gases produced by said engine;

first means responsive to said sensor means for altering an air/fuel feedback signal, which is characterized by a limit cycle frequency, in response to said detected level of oxygen which is characterized by a periodic fluctuation, said first means further comprising means for detecting and storing said limit-cycle frequency;

second means responsive to said sensor means for detecting a transient fluctuation in said detected level of oxygen; and third means responsive to said second means for altering said air/fuel feedback signal in response to said transient fluctuation by an amount substantially proportional and opposite in magnitude to said transient fluctuation.

2. The invention as set forth in claim 1 wherein the second means is further responsive to said stored limit-cycle frequency.

3. A method of controlling the amount of fuel delivered to an internal combustion engine comprising, detecting the oxygen content of the combustion products exhausted by said engine to generate an oxygen signal which provides a rich indication when the oxygen content indicates an air/fuel composition rich of stoichiometry, a lean indication when the oxygen content indicates an air/fuel composition lean of stoichiometry, and a transient indication when the oxygen content indicates a transient change in said air/fuel composition, responding to said rich indication by decreasing the amount of fuel delivered to said engine, responding to said lean indication by increasing the amount of fuel delivered to said engine, responding to said transient fluctuation by abruptly altering the amount of fuel delivered by an amount substantially proportional and opposite in magnitude to said transient fluctuation; and continuing said responding to said rich indication and said responding to said lean indication steps, said rich indication and said lean indication steps being initiated by a response to a rich indication if the transient fluctuation indicated a transient air/fuel composition rich of stoichiometry and is initiated by a response to a lean indication if the transient fluctuation indicated an air/fuel composition lean of stoichiometry.

4. The method as set forth in claim 3 wherein the steps of decreasing, increasing or abruptly altering the amount of fuel delivered to said engine comprises the step of altering an air/fuel feedback signal by an amount substantially proportional and opposite in magnitude to said decrease, increase or abrupt alteration, said air/fuel feedback signal responsive to said oxygen signal.

5. The method as set forth in claim 4 wherein the steps of decreasing, increasing or abruptly altering the amount of fuel delivered to said engine are performed under a closed-loop method of operation.

6. The method as set forth in claim 5 comprising the additional step of monitoring and storing the angular velocity of said engine and the frequency of said air/fuel feedback signal.

7. The method as set forth in claim 6 wherein the transient indication is detected by monitoring the frequency of oscillation of said oxygen signal and comparing said frequency of oscillation to said stored frequency of said air/fuel feedback signal.

8. The method as set forth in claim 7 wherein the magnitude of said transient indication is calculated as a function of said air/fuel feedback signal and the frequency of oscillation of said oxygen signal.

9. In combination, an internal combustion engine for producing an exhaust gas;

an oxygen sensor for detecting the concentration of oxygen in the exhaust gas;

a fuel controller, comprising, first means, responsive to said oxygen sensor, for generating a periodic indication when said oxygen sensor detects a periodic fluctuation in the oxygen content of the exhaust gas, and for generating a transient indication when said oxygen sensor detects a transient fluctuation in the oxygen content of the exhaust gas, said periodic indication characterized by a limit cycle frequency, said first means further comprising means for detecting and storing said limit-cycle frequency;

second means, responsive to said periodic indication, for altering an air/fuel ratio in a manner substantially equal in period and opposite in magnitude to said periodic indication, as a function of said stored limit-cycle frequency; and third means, responsive to said transient indication, for abruptly altering said air/fuel ratio in a manner substantially equal in period and opposite in magnitude to said transient indication.

10. The invention as set forth in claim 9 wherein said transient fluctuation has a magnitude substantially greater than said periodic fluctuation.

* * * * *